United States Patent [19]

Herrington

[11] Patent Number: 4,570,411

[45] Date of Patent: Feb. 18, 1986

[54] BAG FOLDING AND LOADING MACHINE HAVING IMPROVED SWATTER

[75] Inventor: Fox J. Herrington, Holcomb, N.Y.

[73] Assignee: Mobil Oil Corporation, New York, N.Y.

[21] Appl. No.: 654,360

[22] Filed: Sep. 26, 1984

[51] Int. Cl.[4] ..... B65B 63/04

[52] U.S. Cl. ..... 53/117; 53/527; 271/83; 271/180; 414/69

[58] Field of Search ..... 53/117, 116, 427, 527; 271/83, 66, 70, 72, 180, 181; 414/69

[56] References Cited

U.S. PATENT DOCUMENTS

| | | | |
|---|---|---|---|
| 387,249 | 8/1888 | Nash | 271/83 |
| 3,462,026 | 8/1969 | Maccherone | 414/69 X |
| 3,749,397 | 7/1973 | Timm | 271/83 X |
| 4,037,386 | 7/1977 | Sjoman | 53/429 |
| 4,050,591 | 9/1977 | Dunlap | 414/45 |
| 4,472,923 | 9/1984 | Herrington | 53/429 |
| 4,513,559 | 4/1985 | Herrington, Jr. | 53/429 |

*Primary Examiner*—James F. Coan

*Attorney, Agent, or Firm*—Alexander J. McKillop; Michael G. Gilman; Charles J. Speciale

[57] ABSTRACT

A bag folding and loading machine has a pivotal swatter which transfers thin film bags from delivery conveyors to a folding assembly. Vanes on the swatter are located on planes substantially aligned with the direction of motion of the swatter which contacts the bags along three sides of the vanes to form the bags into a U-shaped configuration upon delivery. Pivotal flippers are at the sides of a U-shaped channel into which the bag is delivered. Flippers rotate through 90° to fold the bag in thirds, after which it is transferred to the carton by a stomper.

11 Claims, 18 Drawing Figures

BAG FOLDING AND LOADING MACHINE HAVING IMPROVED SWATTER

BACKGROUND OF THE INVENTION

The present invention relates to the folding and loading of plastic film articles into cartons and more particularly, to an improved swatter and folding mechanism.

The handling and packing of thin film sheet articles such as trash bags, produce bags, and sandwich bags, present particular problems because the film is thin, limp and subject to static electricity.

Co-pending applications Serial No. 329,371, filed Dec. 10, 1981, and now abandoned, "INDIVIDUAL BAG FOLDER AND CARTON LOADER AND METHOD FOR OPERATION THEREOF", Herrington, and a continuation-in-part thereof, "BAG TRANSPORTER, FOLDER AND LOADER AND METHOD OF OPERATION, Serial No. 488,243, filed Apr. 25, 1983, now U.S. Pat. No. 4,513,559 describe a mechanism which folds a bag in thirds, then loads it directly into a carton. The first step in the process is to lift the bags from conveyor belts which deliver the bags to the folding mechanism. A mechanism referred to as a "swatter" transfers the bags from the conveyor belts to the folding assembly. After the bag is laid on the folding assembly, the swatter must be retracted rapidly to pick up another bag. This rapid retraction may draw the bag back with it due to vacuum that is created between the surfaces of the swatter and the bag.

After the bag is deposited on the folding assembly, it must be accurately folded and then transported to its packing carton. Requirements for machines which perform these functions are reliability, durability, and minimal component failure.

It is an object of the present invention to provide a machine which fulfills the foregoing requirements.

SUMMARY OF THE INVENTION

In accordance with the present invention, a pivotal swatter which transfers thin film sheet bags from a delivery belt to the folding assembly includes a plurality of vanes located on planes substantially aligned with the direction of motion of the swatter. The swatter contacts the bags along three sides of the vanes to form the bags into a U-shaped configuration upon delivery at the loading assembly. Because the bag is contacted along the edges of the vanes, the swatter is easily retracted without pulling the bag with it.

Further in accordance with the invention, the vanes of the swatter are arcuate with the center of the arcs being at the axis about which the swatter is pivoted. Because of this, the edges of the vanes are not dragged across the bag during the pivotal movement.

Further in accordance with the invention, pivotal flippers fold the bag into thirds. The flippers include a flat, rectangular web of metal which is particularly durable. Openings in the web apply a vacuum to the bag. Vacuum is supplied through holes in vacuum blocks which have recesses which receive the flippers. The folding assembly has a platform formed from two resilient plastic trays. After the bag is folded, a stomper pushes the bag through the opening between these trays into the carton. The foregoing and other features make the machine fast, durable and subject to minimal component failure The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1A:
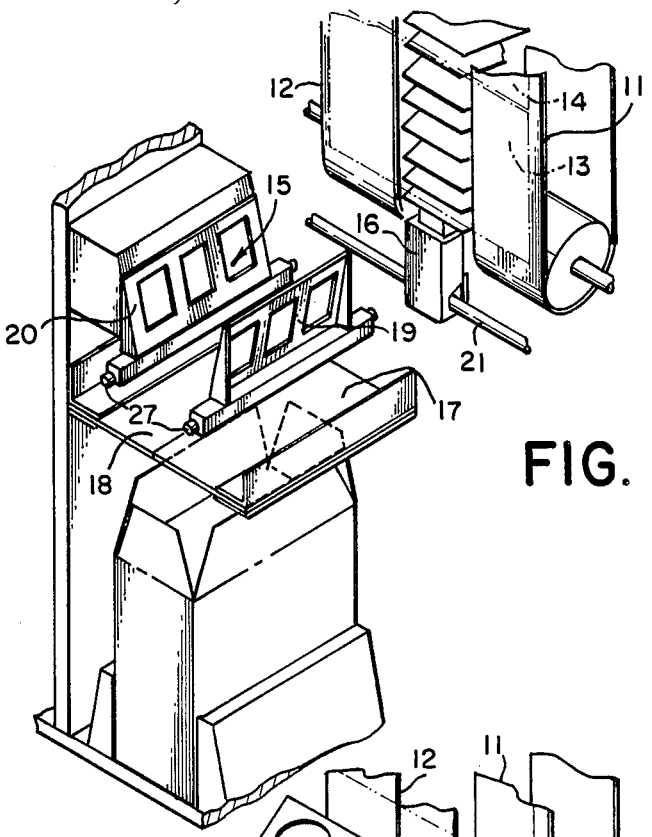
FIGS. 1A–1G depict the machine of the present invention during an operating sequence.

Referring to FIG. 1A, delivery means including conveyor belts 11 and 12 deliver thin film articles such as the polyethylene film sandwich bags 13 and 14 to a folding assembly 15. A pivotal swatter 16 transfers articles from the delivery belts 11 and 12 to the folding assembly 15.

Figure 1B:
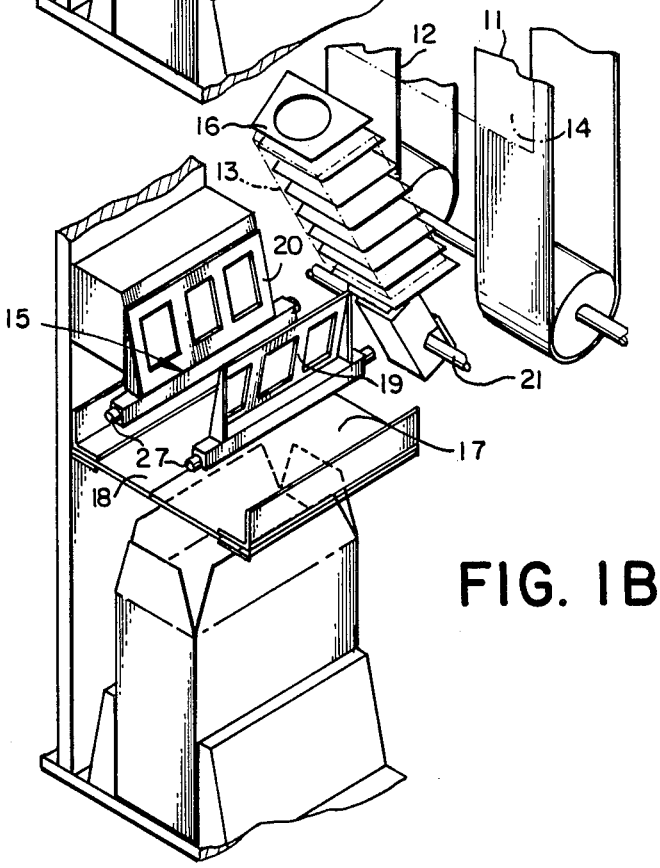
Figure 1C:
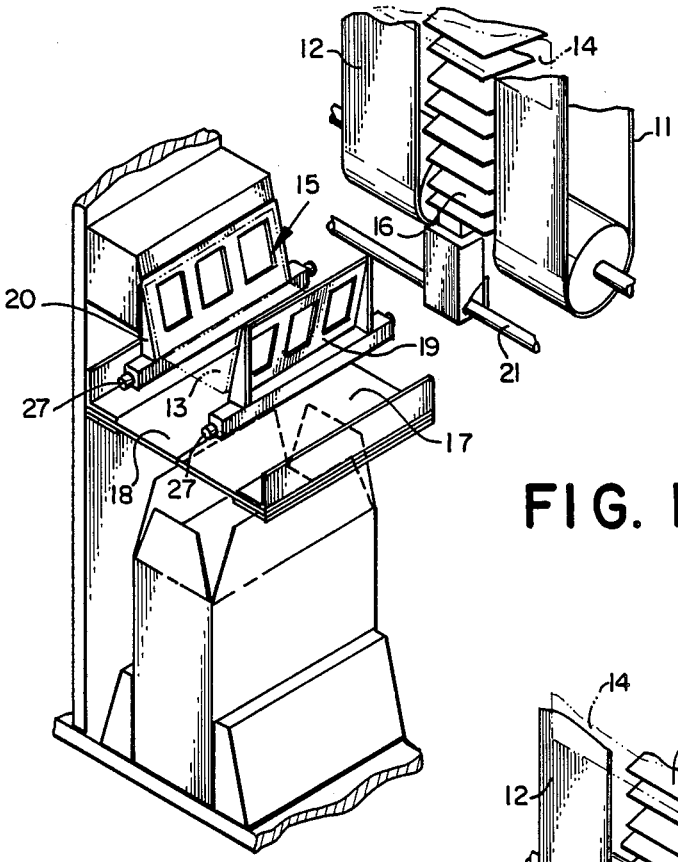

FIG. 1B shows swatter 16 moving bag 13 into a U-shaped channel in the folding assembly. The U-shaped channel is formed by bottom trays 17 and 18 which are disposed in side by side relationship to form a platform which receives the middle portion of the bag. At the sides of the U-shaped channel, a pair of pivotal flippers 19 and 20 are disposed approximately perpendicular to the platform when in article receiving position. As shown in FIG. 1C, the swatter is thereafter pivoted out of the channel to leave the bag, which has been formed into a U-shaped configuration, in the folding assembly.

One of the problems at this stage of the operation is that a typical swatter, such as one formed from sheet metal, may draw the bag back with it when the swatter is retracted due to vacuum that is created between the surfaces of the swatter and the bag. Expedients, such as perforating the sheet metal, reduce the problem, but there is a tendency for the bag to hang up in the holes through the sides.

The present invention obviates such problems by the swatter which is more fully shown in FIGS. 2–7. The swatter is pivoted at 21 and includes vanes 22, 23....24 which are located on planes substantially aligned with the direction of motion of the pivotal swatter. The swatter contacts the bag along the bottom and two sides of the vanes to form the bag into the U-shaped configuration. As best shown in the side view of FIG. 2, the sides of the vanes are arcuate with the centers of the arc being at the pivot 21. Because of this, during pivotal movement of the swatter an edge of a vane does not drag across the film of the bag. Because the swatter contacts the bag only along the edges of the metal vanes, problems of drawing the bag back as the swatter is pivoted are avoided.

The swatter 16 is machined from a single piece of aluminum, although other materials such as steel or plastic could be used. The vanes are cut by milling the block of aluminum while rotating it about the central axis of the block.

Figure 1D:
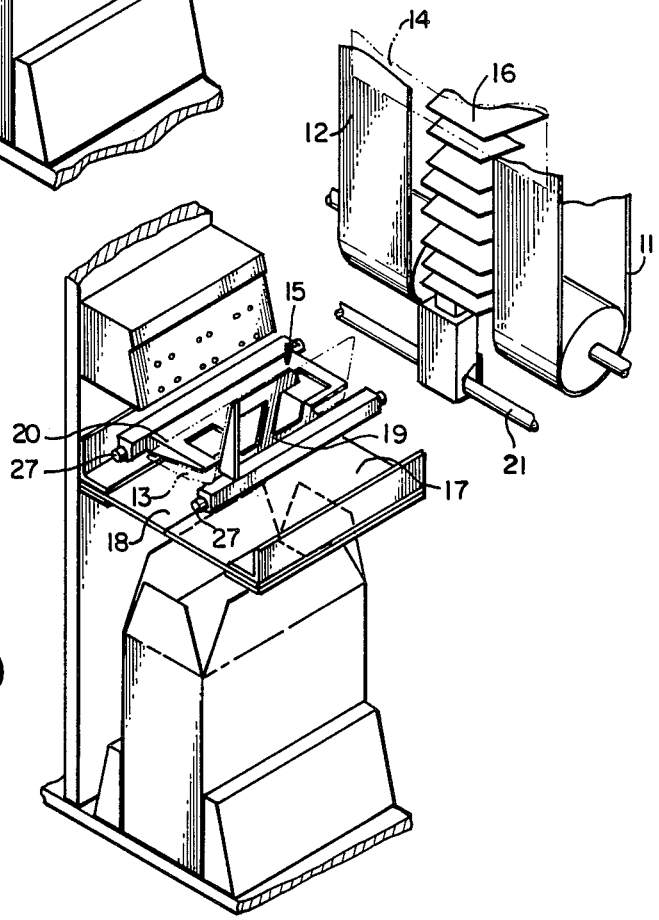
Figure 1E:
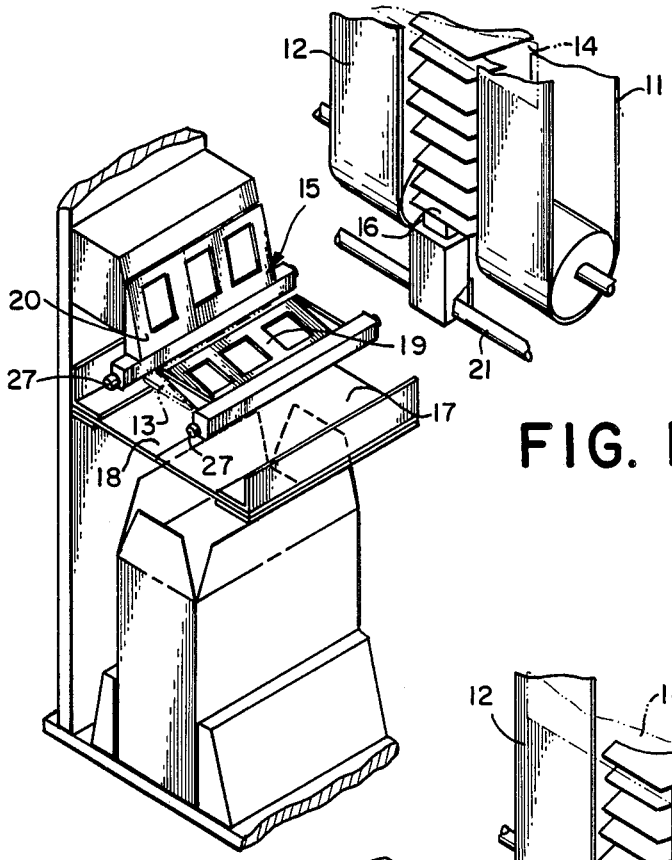
Figure 8:
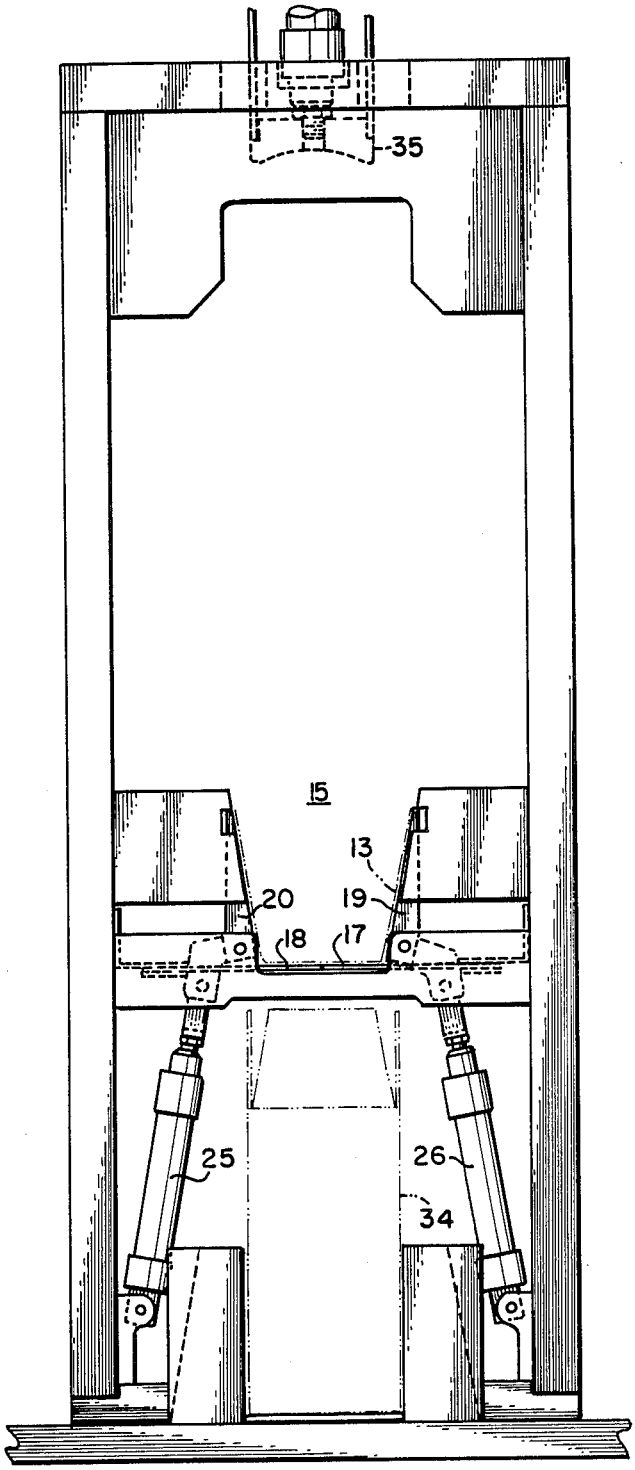
FIG. 8 is a front view of the folding assembly.
Figure 9:
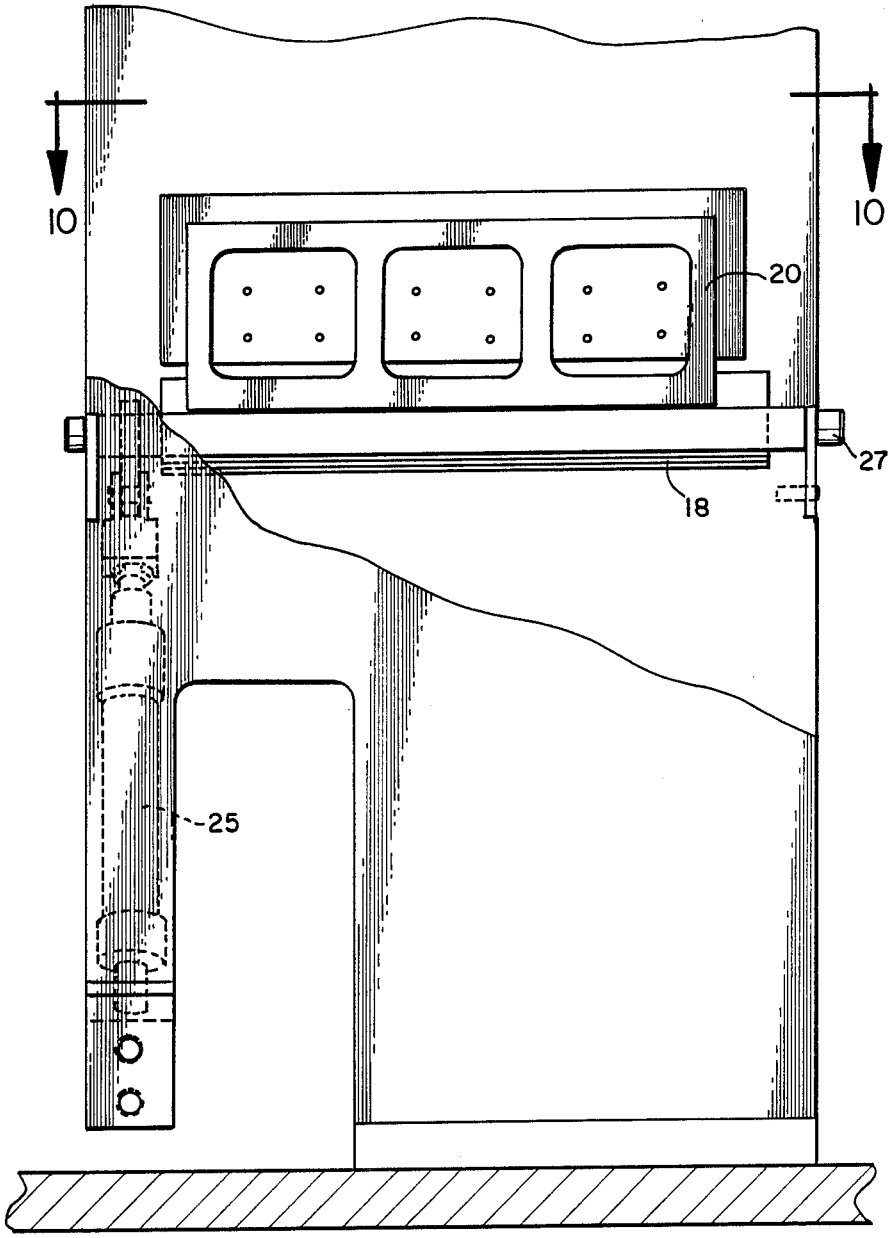
FIG. 9 is a side view of the folding assembly.
Figure 10:
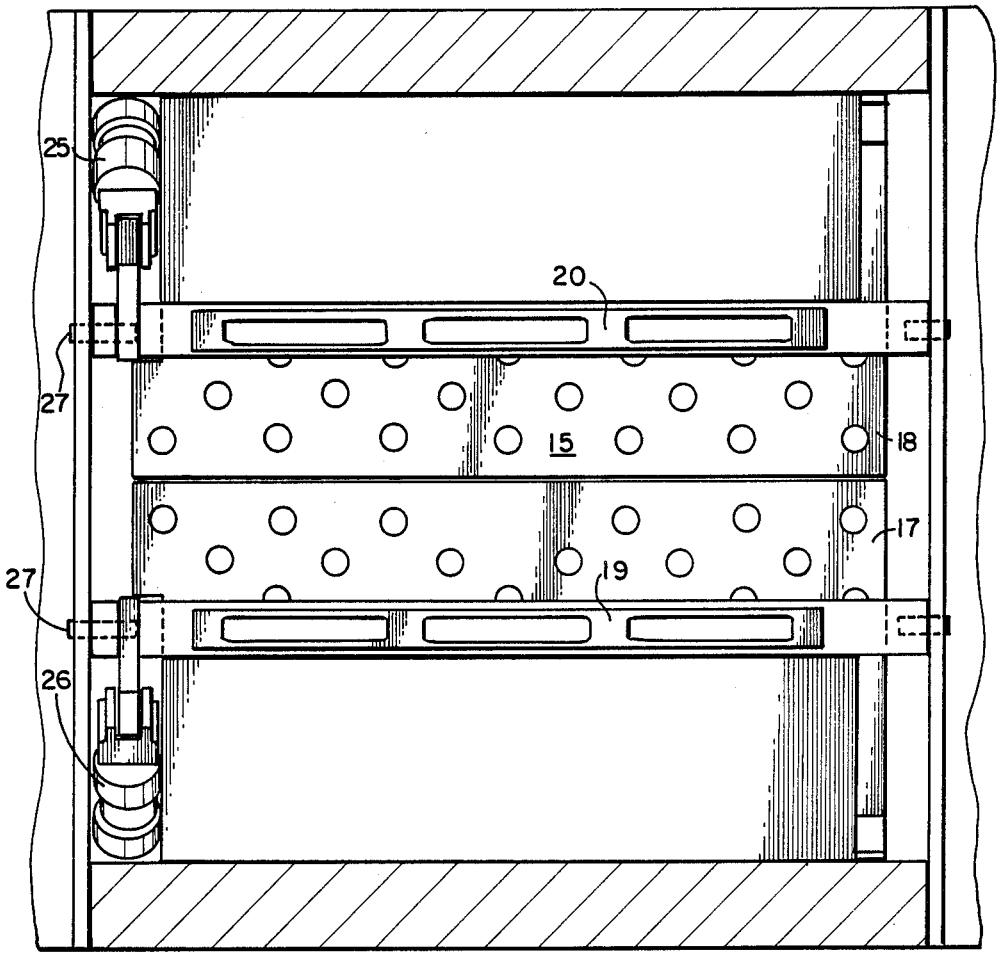
FIG. 10 is a view on the line 10—10 of FIG. 9.

FIGS. 8–10 show the folding assembly in more detail. Vacuum blocks 28 and 29 are on both sides of the U-shaped channel into which the bag is moved by the swatter. The vacuum blocks are relieved so that the flippers 19 and 20 fit into recesses in the blocks. Openings 30 and 31 in the vacuum blocks apply a vacuum through the flippers to the bag to hold it in the channel. The actuators for the flippers include an air cylinder 25 for pivoting flipper 20 through about 90° to lay one end of the bag onto the middle of the bag. This operation is depicted in FIG. 1D. Air cylinder 25 then returns flipper 20 to the article receiving position. Similarly, air cylinder 26 pivots flipper 19 about 90° to lay the other end of the bag onto the first end so that the bag is folded in thirds. This operation is depicted in FIG. 1E. Then, the flipper is returned to the article receiving position.

In accordance with the invention, the flippers are generally flat, rectangular webs of metal having openings therein. As best shown in FIG. 9, flipper 20 is pivoted on shaft 27 along one edge of the web. The flippers are fabricated from aluminum and have high durability, particularly when compared with the tines used to perform the corresponding function as shown in the aforementioned application.

Figure 1F:
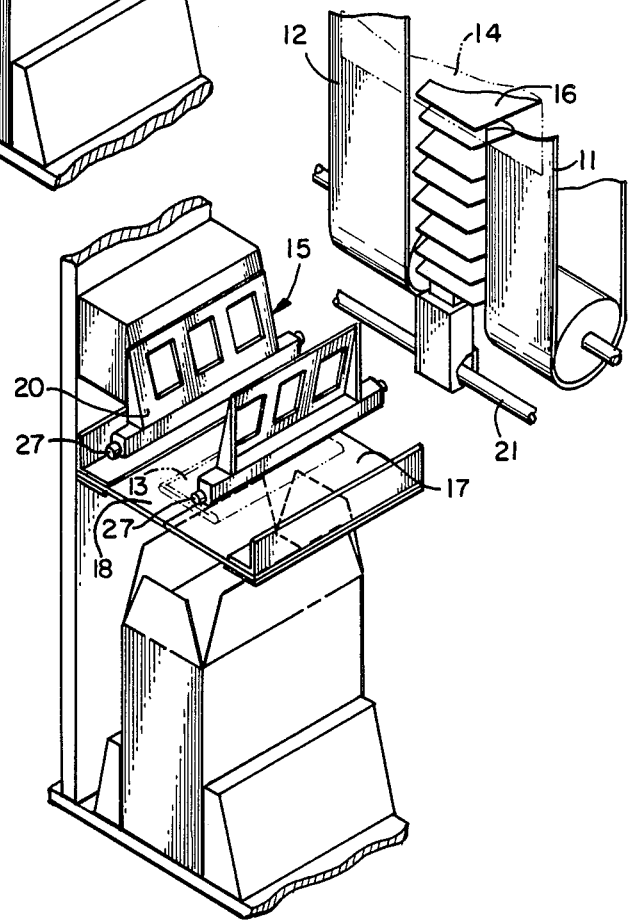

The folded bag lies on a platform at the bottom of the U-shaped channel. The platform is formed by the trays 17 and 18. Trays 32 and 33 are fabricated from a resilient plastic such as Mylar. FIG. 1F depicts the stage of operation at which the folded bag rests on the platform formed by the trays 17 and 18.

Figure 1G:
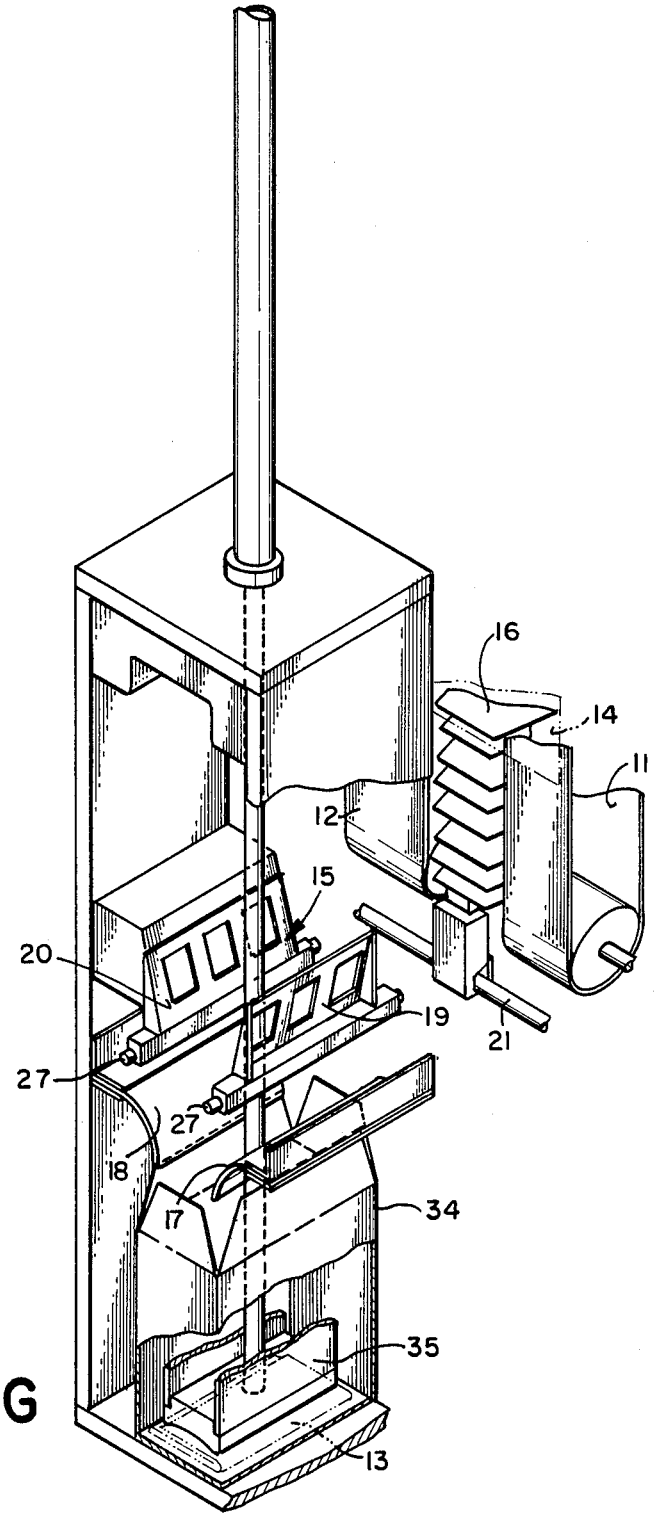
Figure 2:
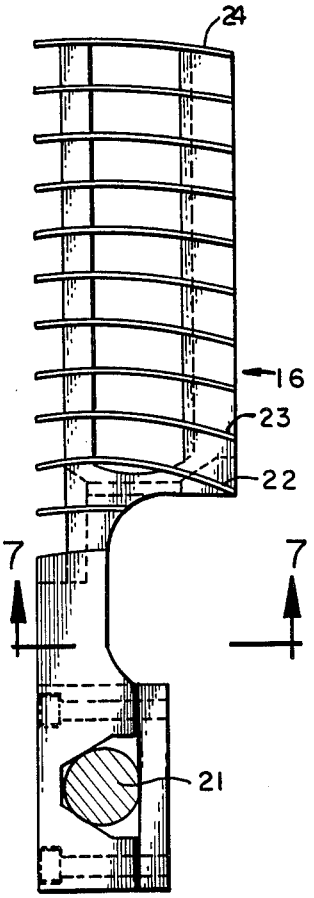
FIG. 2 is a side view of the swatter of the present invention.
Figure 3:
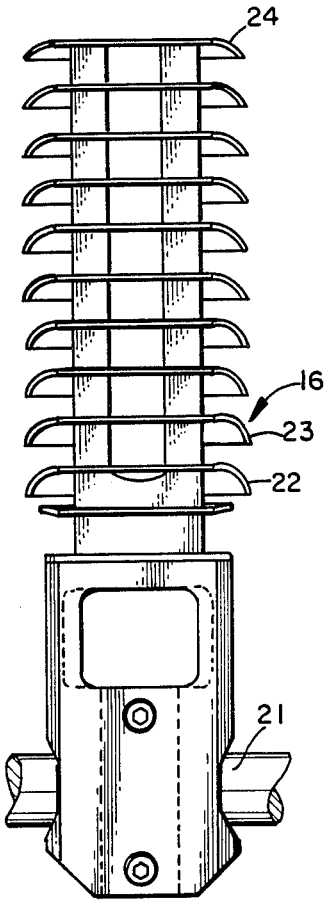
FIG. 3 is a top view of the swatter.
Figure 4:
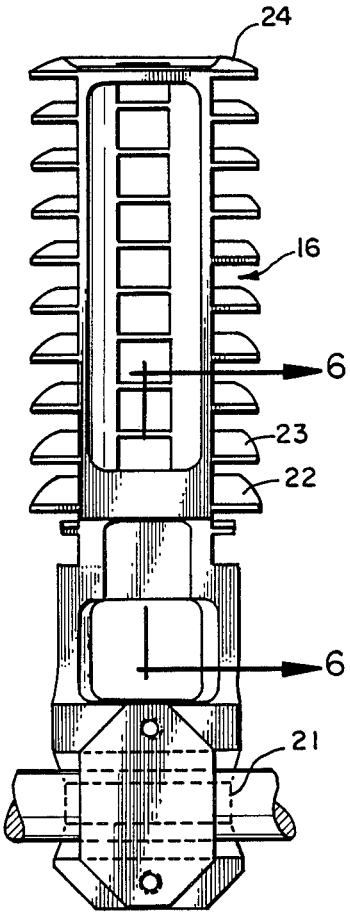
FIG. 4 is a bottom view of the swatter.
Figure 5:
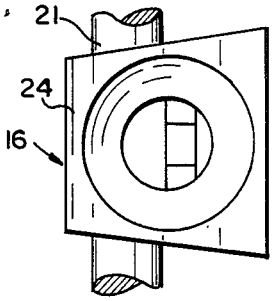
FIG. 5 is an end view of the swatter.
Figure 6:
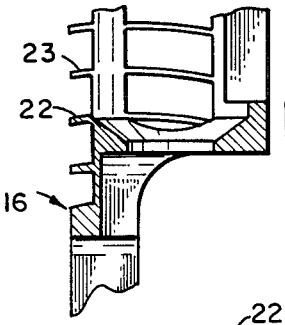
FIG. 6 is a view on the line 6—6 of FIG. 4.
Figure 7:
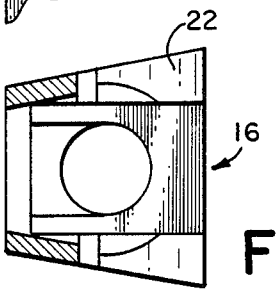
FIG. 7 is a view on the line 7—7 of FIG. 2.

In order to insert the folded bag into the carton 34, a stomper 35 is lowered. As the stomper 35 is lowered, it pushes the folded bag through the opening between the trays 32 and 33. Since the trays are resilient, they allow the stomper 35 to push the bag into the carton 34 and to the top of the stack of folded bag in the carton. This operation is depicted in FIG. 1G.

Stomper 35 has a generally rectangular shape conforming with the inside of carton 34. Stomper 35 has a domed bottom which facilitates disengagement from the stack of bags when the stomper is retracted.

Figure 11:
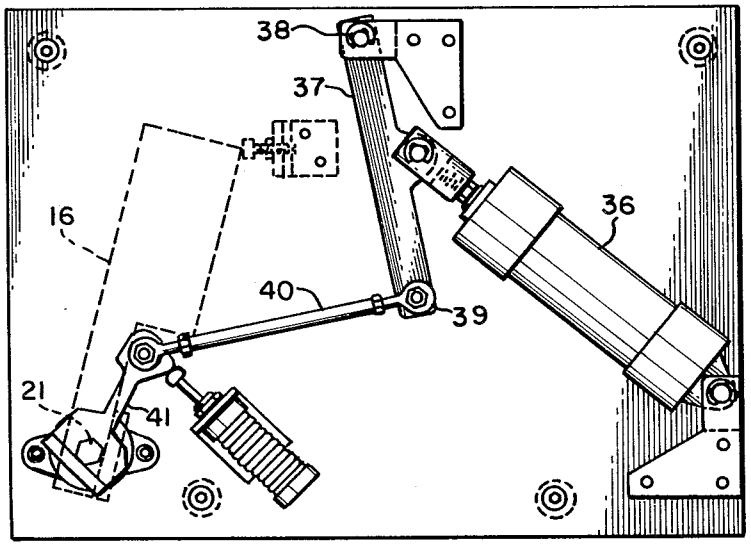
FIGS. 11 and 12 show the actuating mechanism for the swatter.
Figure 12:
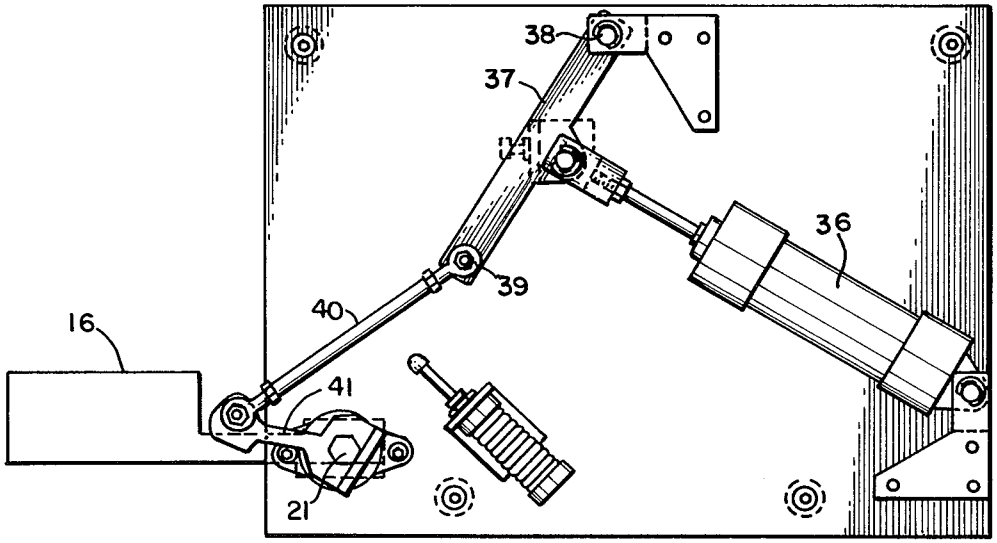

FIGS. 11 and 12 show the actuating mechanism for pivoting the swatter 16. An air operated cylinder 36 moves the swatter 16 between its retracted position, shown in FIG. 11, and the operated position at which it lays a bag in the U-shaped channel, as shown in FIG. 12. An arm 37 is pivoted at 38. The moving end 39 of arm 37 is connected to a link 40 which operates the arm 41 on the shaft 42 on which the swatter 16 is mounted. Arm 37 and link 40 are part of a lost motion mechanism which imparts a high initial velocity to the swatter as it starts its motion. However, as the swatter approaches the U-shaped channel, the motion slows considerably to avoid abusive contact as the swatter deposits the bag on the folding platform. Upon retraction, the mechanism contacts damper 43 which dampens the retraction motion.

While a particular embodiment of the invention has been shown and described, various modifications are within the spirit and scope of the invention. The appended claims are, therefore, intended to cover all such modifications.

What is claimed is:

1. A machine for folding and loading thin film sheet articles into a carton comprising:

a folding assembly;

delivery means for delivering said thin film articles to a position adjacent said folding assembly; and a pivotal swatter for transferring said articles from said delivery means to said folding assembly, said pivotal swatter including:

a plurality of vanes located on planes substantially aligned with the direction of motion of said pivotal swatter, said swatter contacting said article along three sides of said vanes to form said article into a U-shaped configuration upon delivery at said loading assembly.

2. The machine recited in claim 1 wherein the vanes of said swatter are arcuate with the centers of the arcs being at the axis about which said swatter is pivoted so that during pivotal movement of said swatter an edge of the vane does not drag across said articles.

3. The machine recited in claim 1 wherein said folding assembly comprises:

a platform adapted to receive at least the middle portion of said article; and a pair of pivotal flippers which are disposed approximately perpendicular to said platform when in article-receiving position and are spaced apart to form a U-shaped channel, said swatter being pivoted into said U-shaped channel to deposit said article therein, said swatter being thereafter pivoted out of said channel.

4. The machine recited in claim 3 further comprising:

a first actuator for pivoting one of said flippers through about 90° to lay one end portion of said article onto said middle portion and for returning said flipper to the article-receiving position;

another actuator for pivoting the other flipper through about 90° to lay another end portion onto said one end portion so that said article is fully folded and returning said other flipper to the article-receiving position after said folding.

5. The machine recited in claim 3 further comprising:

vacuum means for applying a vacuum to said U-shaped channel to hold said article therein when said swatter is returned.

6. The machine recited in claim 5 wherein each flipper comprises:

a generally flat rectangular web of metal having openings therein; and a shaft, said rectangular web of metal being pivotally mounted on said shaft along one edge of the web.

7. The machine recited in claim 6 further comprising:

vacuum blocks on both sides of said U-shaped channels, said vacuum blocks being relieved so that said flippers fit into recesses into said blocks; and openings in the recesses of said blocks for applying a vacuum through the openings in said web to the article for holding it in said channel.

8. The machine recited in claim 3 wherein said platform comprises:

a pair of resilient trays mounted at the extremities thereof and having a central line opening between the trays, said article being pushed through said trays as they deflect about the mounted extremities and into said carton.

9. The machine recited in claim 8 further comprising:

a stomper member having a shape which fits within said carton, said stomper being normally disposed above said platform, said stomper being movable through the opening between said trays to push the folded article into said carton.

10. The machine recited in claim 6 and a mechanism for pivoting said swatter comprising an air-operated cylinder;

a pivoted arm operated by said cylinder and having a moving end opposite the pivoted end;

a link connecting the moving end of said arm to said swatter so that when said air cylinder is operated, said arm and linkage move said swatter in a motion which is slower at the end of the motion than at the beginning of the motion.

11. The machine recited in claim 1 and wherein said article is a thin polyethylene bag.

* * * * *